US005647219A

United States Patent [19]

Rattray et al.

[11] Patent Number: 5,647,219

[45] Date of Patent: Jul. 15, 1997

[54] COOLING SYSTEM USING A PULSE-TUBE EXPANDER

[75] Inventors: Alan A. Rattray, Alta Loma; Carl S. Kirkconnell, Huntington Beach; Steven C. Soloski, Manhattan Beach; Kenneth D. Price, Long Beach; Samuel C. Russo, Arcadia, all of Calif.

[73] Assignee: Hughes Electronics, Los Angeles, Calif.

[21] Appl. No.: 669,657

[22] Filed: Jun. 24, 1996

[51] Int. Cl.[6] ..... F25B 9/00

[52] U.S. Cl. ..... 62/6; 62/620

[58] Field of Search ..... 62/6; 60/520

[56] References Cited

U.S. PATENT DOCUMENTS

| | | | |
|---|---|---|---|
| 5,107,683 | 4/1992 | Chan et al. | 62/6 |
| 5,269,147 | 12/1993 | Ishizaki et al. | 62/6 |
| 5,275,002 | 1/1994 | Inoue et al. | 62/6 |
| 5,295,355 | 3/1994 | Zhou et al. | 62/6 |
| 5,335,505 | 8/1994 | Ohtani et al. | 62/6 |
| 5,412,952 | 5/1995 | Ohtani et al. | 62/6 |
| 5,481,878 | 1/1996 | Shaowei | 62/6 |
| 5,515,685 | 5/1996 | Yanai et al. | 62/6 |

*Primary Examiner*—Ronald C. Capossela

*Attorney, Agent, or Firm*—Michael W. Sales; Wanda K. Denson-Low

[57] ABSTRACT

A cooling system utilizes a pulse-tube expander having a hollow pulse tube and three hollow regenerator tubes that lie parallel to and laterally displaced from the pulse tube, and are arranged in triangular fashion about the pulse tube. A cold end of each of the regenerator tubes is in gas pressure communication with a cold end of the pulse tube. Pulsing gas pressure is supplied to a warm end of each of the regenerator tubes, and a surge volume communicates with a warm end of the pulse tube. A heat sink is provided at the warm end of the regenerator tubes and the pulse tube to remove heat therefrom and from the pulsing gas. Heat is extracted from a heat load at the cold end of the regenerator tubes and the pulse tube.

15 Claims, 2 Drawing Sheets

COOLING SYSTEM USING A PULSE-TUBE EXPANDER

BACKGROUND OF THE INVENTION

This invention relates to cooling devices particularly useful for cooling to low temperatures, and, more particularly, to a cooling system utilizing a pulse tube expander having no moving parts.

Some types of sensors and electronic devices are not practically operable at temperatures above about 50°–75° K. and therefore must be cooled into this temperature range for proper operation. The cooling into this mid-cryogenic range is readily accomplished in some settings, such as a laboratory or a stationary service application, using a reservoir of a cryogenic fluid. In field operations, however, it is often not practical to supply a reservoir of the cryogenic fluid, and thermodynamic-cycle cooling devices must be used.

Several types of thermodynamic-cycle cooling devices are known. One commonly used cooler is based upon the Joule-Thompson gas-expansion principle. Another cooler is the pulse tube expander, based upon a modified Stirling cycle, in which pressurized gas in a regenerator/pulse tube assembly is rapidly pulsed such that compression work is done in the warm region of the assembly to remove heat from the expander, and expansion work is done in the cold region to absorb a thermal load. Pulse tube refrigeration devices are reasonably efficient, have minimal vibration, are dependable over long service lives, and are of moderate cost. The present invention deals with a cooling system utilizing an improved form of the pulse tube expander.

A basic pulse tube expander refrigerator has a regenerator linearly in series with the pulse tube, producing quite a long structure. One design modification to make the device more compact and simplify the heat rejection is a concentric design wherein a pulse tube of relatively small diameter is positioned inside and along the cylindrical axis of an annular regenerator of larger diameter. This design halves the total length of the linear device and colocates the heat rejection spaces within a single heat exchanger block, thereby simplifying the thermal management. In such a design, the regenerator must be radially insulated from the pulse tube, so that each component maintains its optimal axial temperature profile.

Most commonly, the insulation is provided by a vacuum gap between the outer wall of the pulse tube and the inner wall of the regenerator. While such a design is operable, its fabrication is relatively expensive due to the need for careful sealing of the vacuum structure and the numerous components involved. Vacuum ports must also be provided and sealed after the vacuum space is evacuated. If a vacuum leak is present or develops during service, the performance of the concentric pulse tube expander gradually degrades. Such degradation is a particular concern where the pulse tube expander must be operable continuously over a long life or after extended storage periods, a circumstance often encountered in the cooling of sensors.

There is a need for an improved pulse tube expander that has the advantages of other pulse tube expanders, but is both compact and not susceptible to degradation effects such as experienced in the conventional concentric design. The present invention fulfills this need, and further provides related advantages.

SUMMARY OF THE INVENTION

The present invention provides a cooling system utilizing a pulse tube expander. A pulsing gas pressure source drives the pulse tube expander. Numerous types of cold-end heat loads can be cooled with the system, such as sensors, electronic devices, and superconductors. Other applications include cryogenic refrigeration and more-conventional refrigeration. The pulse tube expander is compact but requires no separate vacuum insulation structure (other than being placed within a vacuum space). Accordingly, the pulse tube expander is simpler, more reliable, and less costly to produce than prior concentric pulse tube refrigerators.

In accordance with the invention, a cooling system comprises a hollow pulse tube having a cold end, a warm end, and a pulse tube axis. The pulse tube comprises a cold end heat exchanger and flow straightener, and a warm end heat exchanger and flow straightener. A gas outlet tube is in gas pressure communication with the warm end heat exchanger and flow straightener of the pulse tube. There are at least two hollow regenerator tubes, each having a cold end, a warm end, and a regenerator tube axis. In a preferred design, there are three regenerator tubes arranged parallel to and laterally displaced from the central pulse tube. The three regenerator tubes are positioned at the vertices of an equilateral triangle with the pulse tube at the center of the triangle, when the device is viewed in sectional view perpendicular to the pulse tube axis, a design having high structural rigidity. Each regenerator tube axis is parallel to and laterally displaced from the pulse tube axis. Each regenerator tube comprises a porous regenerator medium packed within the regenerator tube, and a warm end heat exchanger. A gas inlet tube is in gas pressure communication with the warm end heat exchanger of each regenerator tube. A cold end flow channel communicates between the cold end of each regenerator tube and the cold end heat exchanger and flow straightener of the pulse tube. A heat sink is in thermal communication with the warm end heat exchanger and flow straightener of the pulse tube and with the warm end heat exchanger of each regenerator tube. A pulsing gas pressure source is in gas pressure communication with the gas inlet tube, and a heat load is in thermal communication with the cold end of the pulse tube and the cold end of each of the regenerator tubes.

In the preferred approach, each of the regenerator tubes is laterally displaced from the pulse tube and separated by a well-defined gap that serves to insulate the tubes from each other. There is no easy radial heat flow path between the regenerator tubes and the pulse tube. The tube portion of the pulse tube expander is compact both longitudinally and transversely and is three-fold symmetric about the pulse tube axis. External access is required from only one end, termed the warm end, so that in a preferred design the entire pulse tube expander assembly is built on a flanged heat sink head that is readily attached to a port in a structure whose interior is to be refrigerated.

Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
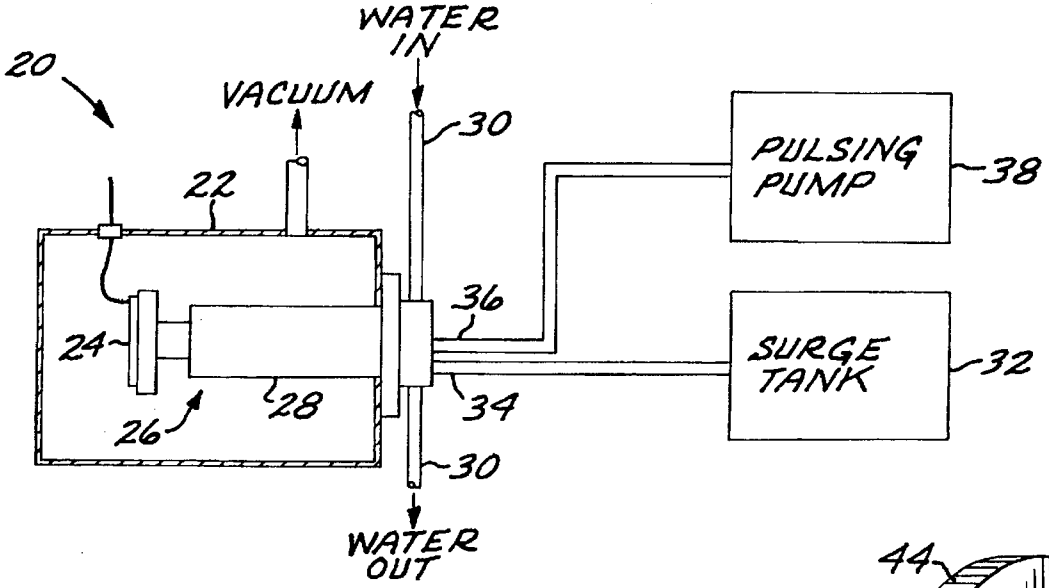
FIG. 1 is a diagrammatic depiction of a cooling system according to the present invention.

FIG. 1 depicts a typical application of the present invention, a cooling system 20 having an insulated, evacuated dewar 22 in which is received a device 24 and a refrigerator 26 in thermal communication with the device 24. The device 24 may be, for example, an integrated circuit device, a sensor (if the facing wall of the insulated dewar 22 is transparent), a superconducting device, or other type of device requiring cooling to reduced temperature. The device 24 and the heat leakage through the walls of the dewar 22 constitute, in part, the heat load for the refrigerator 26.

The refrigerator 26 is a pulse tube expander 28, which will be discussed in greater detail in relation to FIGS. 2–4, extending into the interior of the dewar through a port in its wall. The pulse tube expander 28 requires four external connections, two in a water cooling input/output line 30, a surge tank 32 in gas pressure communication with a gas outlet tube 34, and a pulsing gas pressure source in gas pressure communication with a gas inlet tube 36. The pulsing gas pressure source is preferably a pulsing pump 38 providing helium gas at a pressure of about 250–350 pounds per square inch.

Figure 2:
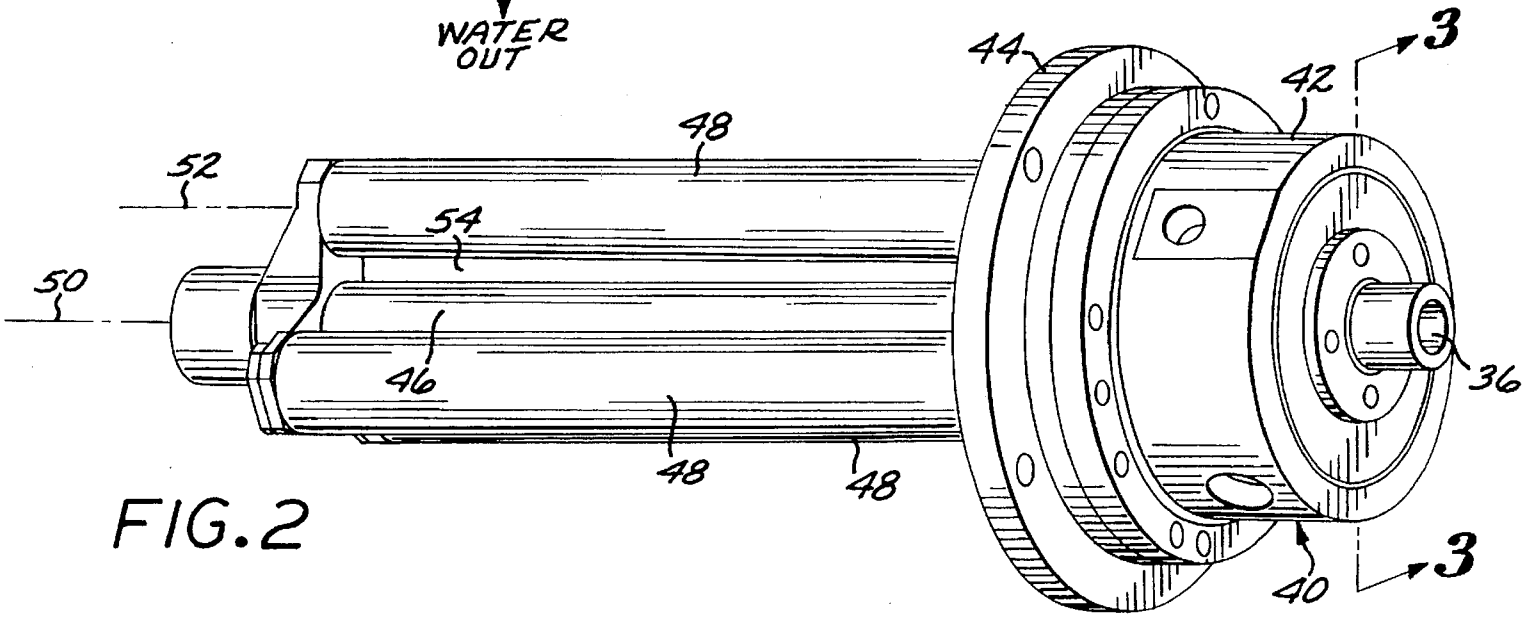
FIG. 2 is a perspective view of a preferred form of the pulse tube expander used in the cooling system of FIG. 1.
Figure 3:
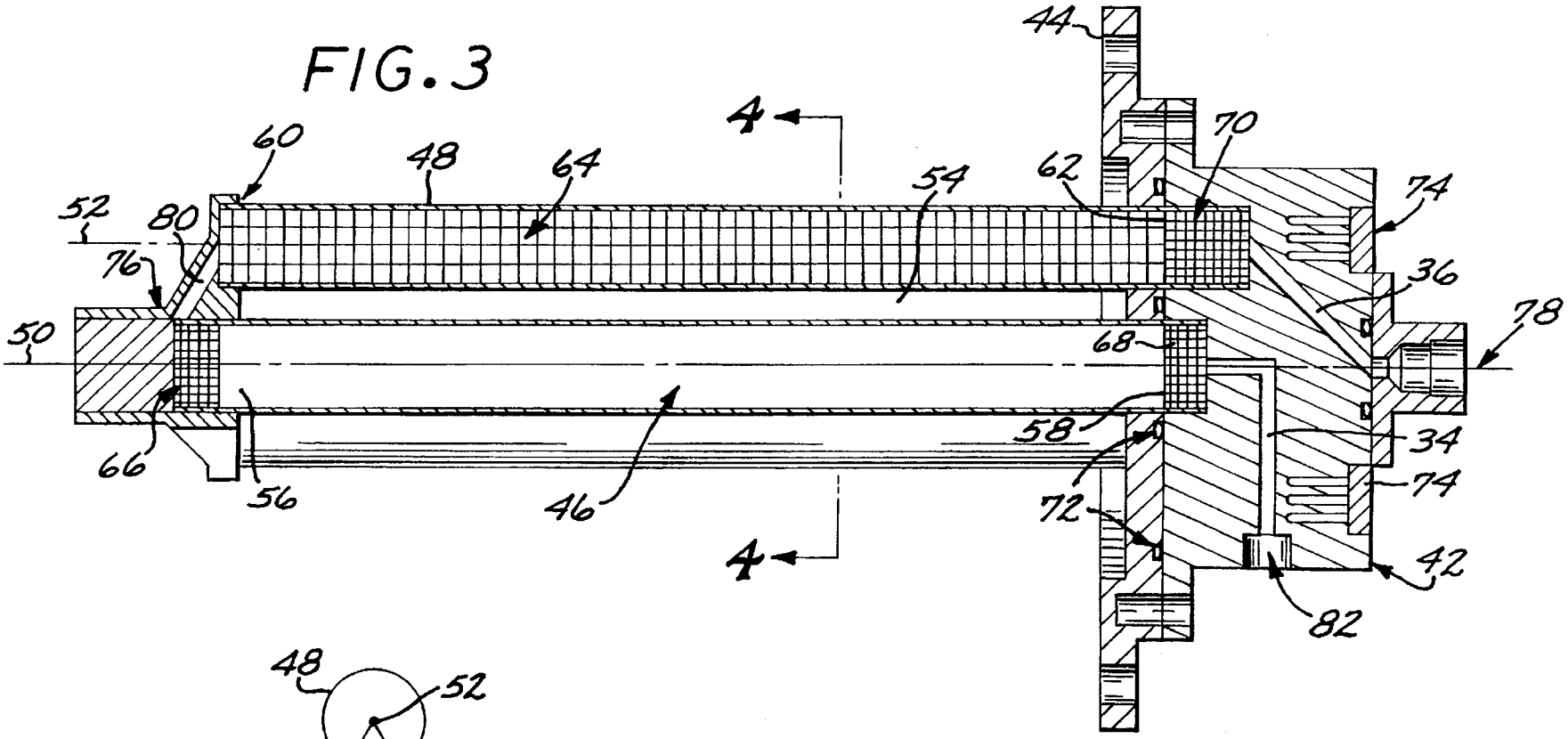
FIG. 3 is a longitudinal sectional view of the pulse tube expander of FIG. 2, taken generally along line 3—3.
Figure 4:
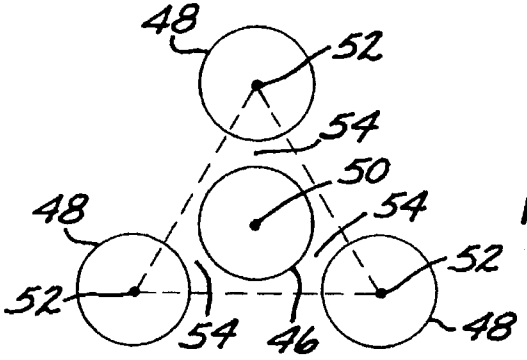
FIG. 4 is a sectional view of the pulse tube expander, taken generally along line 4—4 of FIG. 3.

FIGS. 2–4 illustrate the pulse tube expander 28 in greater detail. The pulse tube expander 28 includes a heat sink 40 in the form of a head 42 affixed to a generally planar flange 44 for bolting to the wall of the dewar 22. At least three, and preferably four, tubes extend inwardly from the head 42 into the interior of the dewar 22, when the pulse tube expander 28 is mounted to the wall of the dewar 22 as in FIG. 1. The tubes include one pulse tube 46 and at least two, and preferably three, regenerator tubes 48. The pulse tube has a pulse tube axis 50 oriented perpendicular to the plane of the flange 44. Each regenerator tube 48 has a regenerator tube axis 52. The regenerator tube axis 52 of each regenerator tube 48 is parallel to but laterally displaced from the pulse tube axis 50. FIG. 4 shows the preferred arrangement of the tubes when viewed in section parallel to the plane of the flange 44, with the pulse tube 46 at the center of an equilateral triangle and the three regenerator tubes 48 at the vertices of the equilateral triangle. As seen in all of FIGS. 2–4, there is a gap 54 between the pulse tube 46 and each of the regenerator tubes 48. This gap 54 serves to convectively and conductively insulate the regenerator tubes 48 from the pulse tube 46.

FIG. 3 shows the internal structure of the pulse tube expander 28, in a longitudinal sectional view through the heat sink 40, the pulse tube 46, and one of the regenerator tubes 48 (all of the regenerator tubes are identical). The pulse tube 46 is described as having a cold end 56 and a warm end 58, and the regenerator tube 48 is described as having a cold end 60 and a warm end 62. These terms refer to the relative temperatures when the pulse tube expander 28 is in operation. When the pulse tube expander 28 is not in operation, the entire device is at uniform temperature, but the descriptive terms are still useful.

In a typical application, the pulse tube 46 has an external diameter of about 1 centimeter, and each regenerator tube 48 has an external diameter of about 1 centimeter. The tubes 46 and 48 are each about 8 centimeters long. The pulse tube 46 and the regenerator tubes 48 are metallic, and are typically made of stainless steel. These dimensions and materials of construction are provided by way of example for a preferred embodiment, and are not limiting of the invention.

The pulse tube 46 is hollow and untilled. The regenerator tubes 48 are hollow and are packed with a porous regenerator medium 64. The regenerator medium 64 is preferably stainless steel screen material of about 400 mesh size. The openings of the screens are preferably aligned so as not to present too high a gas flow impedance.

A cold end heat exchanger and flow straightener 66 is positioned in the interior of the pulse tube 46 at its cold end 56, and a warm end heat exchanger and flow straightener 68 is positioned in the interior of the pulse tube 46 at its warm end 58. A warm end heat exchanger 70 is positioned in the interior of each regenerator tube 48 at its warm end 62. Each of these elements 66, 68, and 70 is preferably made of 40 mesh copper screen.

The head 42 is preferably bolted to the flange 44 (or it may be permanently affixed, as by brazing or welding). The pulse tube 46 and each of the regenerator tubes 48 passes through respective bores in the flange 44 and are joined to the head 42, preferably by brazing. O-rings 72 positioned between the head 42 and the flange 44 prevent gas leakage therebetween. Water ports 74 receive the water cooling lines 30 so that water passes through passages (not shown) in the interior of the head 42 to cool it during operation. Equivalently for the present purposes, the heat exchanger head 42 may be cooled by other techniques such as, for example, a radiator, a heat pipe, or a combination of methods.

At the other end of the pulse tube expander 28, a cold finger 76 is affixed to the cold end 56 of the pulse tube 56 and to the cold end 60 of the regenerator tubes 48. Heat from the heat load flows into the cold finger 76 and thence into the cold end of the pulse tube expander 28.

The reciprocating gas flow path of the pulse tube expander 28 extends, in part, between the pump 38 and the exterior portion of the gas inlet tube 36. In the preferred design of FIGS. 2–4, the exterior portion of the gas inlet tube 36 is joined with a gas-tight joint, preferably a soldered or brazed joint, to an interior portion of the gas inlet tube 36 machined in the head 42 at an inlet port 78. The gas inlet tube 36 is in gas pressure and flow communication with the interior of the regenerator tube 48 at its warm end 62. (Only one of the interior gas inlet tubes 36 is visible in FIG. 3, but in practice there is one such inlet tube 36 communicating between the inlet port 78 and the warm end of each of the regenerator tubes.)

A flow channel 80 provides gas pressure and flow communication between the cold end 60 of each of the regenerator tubes 48 and the cold end 56 of the pulse tube 46.

An interior portion of the gas outlet tube 34 is machined in the head 42. The interior portion of the gas outlet tube 34 provides gas pressure and flow communication between the warm end 58 of the pulse tube 46 and an outlet port 82. At the outlet port 82, the exterior portion of the gas outlet tube 34 is joined to the interior portion with a gas-tight joint, preferably a soldered or brazed joint.

In operation, the pump 38 provides pulses of gas pressure that are typically on the order of 10 cycles per second or more. The working gas, preferably helium, pulses in a to-and-fro pattern within the gas flow channel defined by the gas inlet tube 36, the interior of the regenerator tube 48, the flow channel 80, the interior of the pulse tube 46, the gas outlet tube 34, and the surge tank 32. The cold finger 76 becomes cooler so that heat may be removed from the heat load.

As the temperature falls at the cold end 56 of the pulse tube 46 and the cold end 60 of the regenerator tube 48, temperature gradients develop along the lengths of the tubes 46 and 48. These temperature gradients are not necessarily the same, and therefore it is important that the pulse tube 46 be insulated from the laterally adjacent regenerator tubes 48. In prior folded designs, a smaller-diameter pulse tube was inside and coaxial with a larger-diameter regenerator tube, and insulation was provided by a vacuum space between the outer wall of the pulse tube and the inner wall of the regenerator tube. While operable, this design was difficult to manufacture, assemble, evacuate, and maintain in an evacuated state over long periods in some cases. With the present design, the pulse tube and the regenerate tubes are not coaxial, but instead are parallel but laterally separated by the gap 54. The gap provides thermal insulation between the pulse tube and the regenerator tubes, and no separate vacuum insulation between the pulse tube and the regenerator tubes is required.

A prototype four-tube expander as shown in FIGS. 2–4 has been built and successfully operated. The pressure wave was driven at 22 Hz by a reciprocating compressor piston at a mean pressure of 300 psia. A net refrigeration capacity of 2.3 watts was measured for a load temperature of 70° K. and an input power of about 110 Watts.

Figure 5:
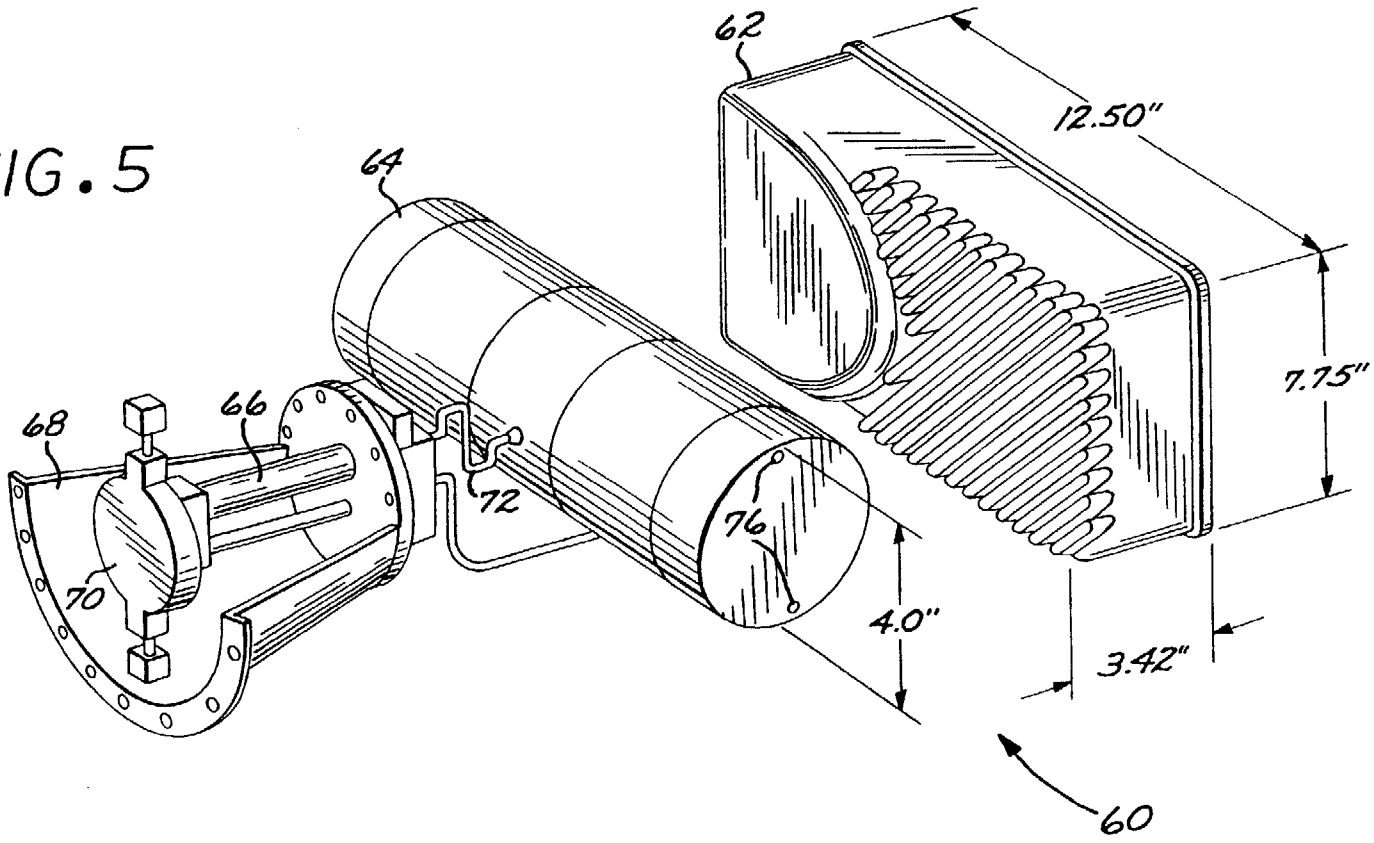

An integrated low cost cryocooler (LCC) system 60 according to an embodiment of the invention is depicted in FIG. 5. The system 60 includes an HTS element (not shown) within a housing 70, a pulse tube expander 66, flexible transfer line 72, surge volume return, electrical connector 76, as well as a linear compressor 64 and electrical box 62. This arrangement is useful for cooling a small HTS device. In order to cool a high temperature superconducting (HTS) based Oscillator package, the LCC system 60 provides cooling up to 4.0 watt at 70 K. For other uses, this same system 60 is capable of producing 2.5 watts at 60 K. and more than 11 watts at 120 K. The selected refrigerator concept and the heat lifting capacities and load temperatures can be readily adapted to different thermal envelopes as well as to different user thermal loads and temperatures.

In FIG. 5, the expander 66 is shown protruding into a cryo envelope containing the cooled electronic device. The expander cold tip is provided with a suitable thermal interface for easy attachment to the users user's equipment and radiation shields (not shown in the Figure) are used for thermal parasitics control. The cooler portion ends at an interface flange, which is an integral part of the expander. As can be seen from the drawing, a rather simple and compact configuration has evolved.

Linear compressor 64 is balanced to the first order, thus benefiting applications sensitive to vibration. The configuration is split so that, the compressor can be isolated on a flexible mount, further lowering the vibration propagated to the system. The pulse tube expander 66 does not contain any moving parts that can cause vibration, and is inexpensive to make and highly immune to failure for the same reason. The expander 66 should be easier to integrate than traditional linear pulse tube expanders, since the cold station is located at an end rather then the middle of the expander.

In the configuration shown in FIG. 5, the expander base is mounted to the flange of the dewar. The (HTS) electronic device within housing 70 and a radiation shield are then mounted to the cold finger flange as a module. The cover of both the dewar and the internal radiation shield are removable to allow easy access to the equipment. Multi Layer Insulation (MLI) can be used to further reduce radiative parasitic loads, if needed. The shape of the radiation shield and dewar facilitate low cost MLI wrapping. Needed electrical connectors and vacuum fittings penetrate the vacuum dewar bas (not shown in the Figure).

Although particular embodiments of the invention has been described in detail for purposes of illustration, various modifications and enhancements may be made without departing from the spirit and scope of the invention. Accordingly, the invention is not to be limited except as by the appended claims.

What is claimed is:

1. A cooling system, comprising:

a hollow pulse tube having a cold end, a warm end, and a pulse tube axis, the pulse tube comprising a cold end heat exchanger and flow straightener, and a warm end heat exchanger and flow straightener;

a gas outlet tube in gas pressure communication with the warm end heat exchanger and flow straightener of the pulse tube;

at least two hollow regenerator tubes, each regenerator tube having a cold end, a warm end, and a regenerator tube axis, each regenerator tube axis being parallel to and laterally displaced from the pulse tube axis, each regenerator tube comprising a porous regenerator medium packed within the regenerator tube, and a warm end heat exchanger;

a gas inlet tube in gas pressure communication with the warm end heat exchanger of each regenerator tube;

a cold end flow channel communicating between the cold end of each regenerator tube and the cold end heat exchanger and flow straightener of the pulse tube; and a heat sink in thermal communication with the warm end heat exchanger and flow straightener of the pulse tube and with the warm end heat exchanger of each regenerator tube.

2. The system of claim 1, further including a pulsing gas pressure source in gas pressure communication with the gas inlet tube.

3. The system of claim 1, wherein the at least two regenerator tubes comprises three regenerator tubes whose regenerator tube axes are arranged in a triangular fashion about the pulse tube axis.

4. The system of claim 1, wherein the heat sink comprises a head having an outlet passage therethrough, and an inlet passage therethrough, and wherein the warm end of pulse tube is joined to the head such that an interior of the pulse tube has gas pressure communication with the outlet passage, so that the outlet passage serves as at least a portion of the gas outlet tube, and the warm end of each regenerator tube is joined to the head such that an interior of each regenerator tube has gas pressure communication with the inlet passage, so that the inlet passage serves as at least a portion of the gas inlet tube.

5. The system of claim 4, where the head further includes a water-flow passage therethrough.

6. The system of claim 1, wherein the porous regenerator medium comprises a metallic screen.

7. The system of claim 1, further including a tip affixed to the cold end of the pulse tube and to the cold end of each of the regenerator tubes.

8. The system of claim 1, further including a heat load in thermal communication with the cold end of the pulse tube and the cold end of each of the regenerator tubes.

9. The system of claim 8, wherein the heat load is a sensor.

10. A cooling system, comprising:

a hollow pulse tube having a cold end, a warm end, and a pulse tube axis, the pulse tube comprising a cold end heat exchanger and flow straightener, and a warm end heat exchanger and flow straightener;

a gas outlet tube in gas pressure communication with the warm end heat exchanger and flow straightener of the pulse tube;

three hollow regenerator tubes, each regenerator tube having a cold end, a warm end, and a regenerator tube axis, each regenerator tube axis being parallel to and laterally displaced from the pulse tube axis with the three regenerator tube axes arranged about the pulse tube axis in a triangular arrangement, each regenerator tube comprising a porous regenerator medium packed within the regenerator tube, and a warm end heat exchanger;

a gas inlet tube in gas pressure communication with the warm end heat exchanger of each regenerator tube;

a cold end flow channel communicating between the cold end of each regenerator tube and the cold end heat exchanger and flow straightener of the pulse tube;

a heat sink in thermal communication with the warm end heat exchanger and flow straightener of the pulse tube and with the warm end heat exchanger of each regenerator tube;

a pulsing gas pressure source in gas pressure communication with the gas inlet tube; and a heat load in thermal communication with the cold end of the pulse tube and the cold end of each of the regenerator tubes.

11. The system of claim 10, wherein the heat sink comprises a head having an outlet passage therethrough, and an inlet passage therethrough, and wherein the warm end of pulse tube is joined to the head such that an interior of the pulse tube has gas pressure communication with the outlet passage, so that the outlet passage serves as at least a portion of the gas outlet tube, and the warm end of each regenerator tube is joined to the head such that an interior of each regenerator tube has gas pressure communication with the inlet passage, so that the inlet passage serves as at least a portion of the gas inlet tube.

12. The system of claim 11, where the head further includes a water-flow passage therethrough.

13. The system of claim 10, wherein the porous regenerator medium comprises a metallic screen.

14. The system of claim 10, further including a tip affixed to the cold end of the pulse tube and to the cold end of each of the regenerator tubes.

15. A cooling system, comprising:

a hollow pulse tube having a cold end, a warm end, and a pulse tube axis, the pulse tube comprising a cold end flow straightener, and a warm end flow straightener;

a gas outlet tube in gas pressure communication with the warm end flow straightener of the pulse tube;

at least two hollow regenerator tubes, each regenerator tube having a cold end, a warm end, and a regenerator tube axis, wherein each regenerator tube axis is non-collinear with the pulse tube axis, wherein the pulse tube does not lie within any regenerator tube, each regenerator tube comprising a porous regenerator medium packed within the regenerator tube, and a warm end heat exchanger;

a gas inlet tube in gas pressure communication with the warm end heat exchanger of each regenerator tube;

a cold end flow channel communicating between the cold end of each regenerator tube and the cold end flow straightener of the pulse tube; and a heat sink in thermal communication with the warm end heat flow straightener of the pulse tube and with the warm end heat exchanger of each regenerator tube.

* * * * *

UNITED STATES PATENT AND TRADEMARK OFFICE

CERTIFICATE OF CORRECTION

PATENT NO : 5,647,219

DATED : July 15, 1997

INVENTOR(S) : Alan A. Rattray, et al.

It is certified that error appears in the above-identified patent and that said Letters Patent is hereby corrected as shown below:

On the title page: Item

73, after "Assignee", please delete "Hughes Electronics, Los Angeles, Calif." and insert --Raytheon Company, Lexington, Mass.-- column 1, below the title, please insert the following paragraph:

--This invention was made with Government support under Contract No. N00014-94-C-2128 awarded by the Department of the Navy. The Government has certain rights in this invention.--

Signed and Sealed this

Twenty-third Day of May, 2000

*Attest:*

Q. TODD DICKINSON

*Attesting Officer*

*Director of Patents and Trademarks*

UNITED STATES PATENT AND TRADEMARK OFFICE

CERTIFICATE OF CORRECTION

PATENT NO. :5,647,219
DATED :July 15, 1997
INVENTOR(S) :Rattray, et al

It is certified that error appears in the above-identified patent and that said Letters Patent is hereby corrected as shown below:

In the Drawings:

Change "Sheet 1 of 2" to –Sheet 1 of 3—

Change "Sheet 2 of 2" to –Sheet 2 of 3 –

Insert Fig. 5, see attached drawing.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*